US006984178B1

(12) United States Patent
Chen

(10) Patent No.: US 6,984,178 B1
(45) Date of Patent: Jan. 10, 2006

(54) GOLF BALL DISPENSING DEVICE

(76) Inventor: Chih Hsing Chen, PO Box 82-144, Taipei (TW)

( * ) Notice: Subject to any disclaimer, the term of this patent is extended or adjusted under 35 U.S.C. 154(b) by 0 days.

(21) Appl. No.: 10/870,069

(22) Filed: Jun. 18, 2004

(51) Int. Cl.
*A63B 69/36* (2006.01)

(52) U.S. Cl. ..... 473/136

(58) Field of Classification Search ..... 473/132, 473/134, 136, 137
See application file for complete search history.

(56) References Cited

U.S. PATENT DOCUMENTS 4,355,811 A * 10/1982 Williams, Sr. ..... 473/136
5,078,401 A * 1/1992 Fehrenbach et al. ..... 473/133
5,351,964 A * 10/1994 Kruger ..... 473/136
5,672,124 A * 9/1997 Pecoraro et al. ..... 473/136

* cited by examiner

*Primary Examiner*—Steven Wong
(74) *Attorney, Agent, or Firm*—Leong C. Lei

(57) ABSTRACT

A golf ball dispensing device is disclosed. The device body includes an elevating device, a ball seat and a railing device. The ball seat, corresponding to the end side of the railing device, is mounted to the elevating device, allowing up and down movement. When the ball seat moves upward, golf ball is loaded and when the ball seat moves downward, golf ball is placed onto the ball seat from the railing device. The elevating device, the railing device are respectively mounted with a plurality of sensors and motor. The dispensing device can automatically provide golf balls ready for practicing.

9 Claims, 6 Drawing Sheets

PRIOR ART

GOLF BALL DISPENSING DEVICE

BACKGROUND OF THE INVENTION (a) Technical Field of the Invention

The present invention relates to a dispensing device for golf balls, and in particular, a dispensing device that is mounted on the ground for practicing of golf.

(b) Description of the Prior Art

FIGS. 1 and 1A disclose a self golf ball dispensing device 10 and a conventional golf tee 20. When the pedal 101 positioned at the side of the device 10 is stepped, a golf ball 30 is discharged from the outlet 102 and the ball 30 is placed at the upper end of the golf tee 20 for swinging. Taiwanese Patent Publication Nos. 271086, 281925, 291099, 296643, 308893 and 343555 discloses a dispensing device 10 for golf ball and the elevating mechanism for the dispensing. The drawback of the conventional device is to manually place the ball onto the upper end of the golf tee 20.

Therefore, it is an object of the present invention to provide a dispensing device for golf balls which can obviate and mitigate the above-mentioned drawbacks.

SUMMARY OF THE INVENTION

Accordingly, it is an object of the present invention to provide a golf ball dispensing device comprising an elevating means, a ball seat and a railing means, characterized in that the elevating means includes a seat body, an elevating power module, a sliding block and a first to forth sensor, and the seat body is mounted on the body of the dispensing device and is connected to the elevating power module and the sensors, and the sliding block is pivotally mounted to the elevating power module, and the elevating power module is provided with a motor, the elevating power module is capable to move upward or downward to the upper point and the lower point; the ball seat includes a base seat and ball-holding rod, and the base seat is mounted to the sliding block of the elevating means so that the base seat moves together with the sliding block, and the base seat is extended with an extension rod so that the elevation to the upper point and the lower point is stopped by the sensing of the first and second sensor; the railing means includes at least two railing plate, railing body, a second motor and a ball-pushing seat, and the two railing plates are connected to the body of the dispensing device, and the railing body is mounted between two railing plates and the second motor is connected to the railing plate and to drive the ball-pushing seat to rotate, the ball-pushing seat has a ball-holding section at one side, allowing a golf ball to be placed on the railing body, and a second motor drives the ball-pushing seat to rotate and the ball-holding section is used to push the golf ball to move forward to the elevating means, and the golf ball to drop onto the ball-holding rod of the ball seat.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figures 1, 1A:
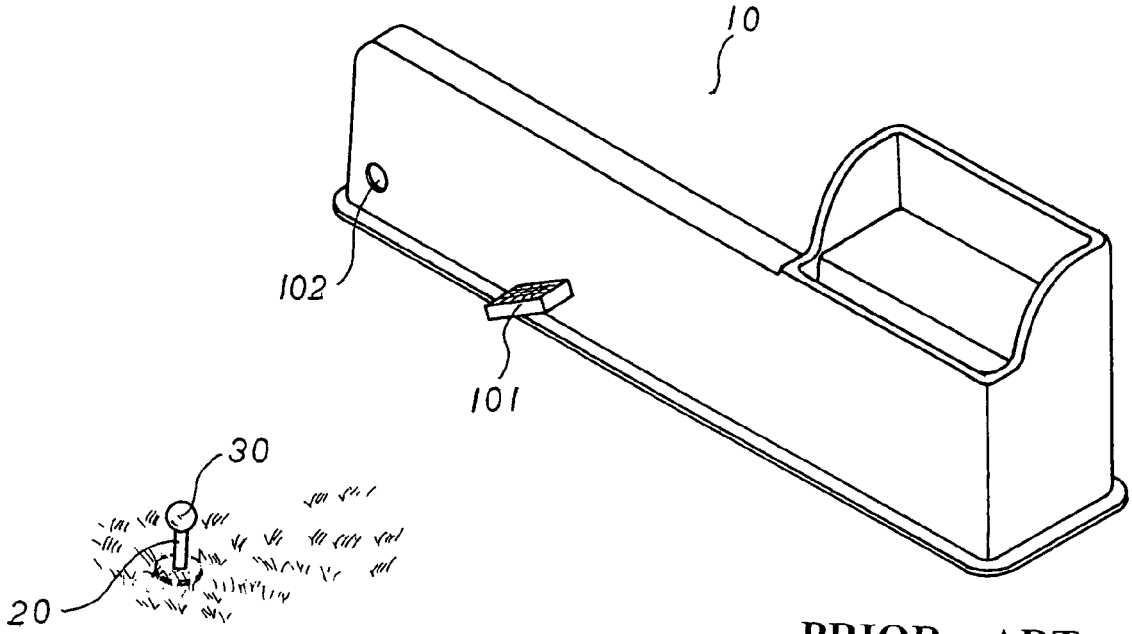
FIG. 1 PRIOR ART
FIG. 1 is a perspective view of a conventional golf ball dispensing device.
FIG. 1A is a perspective view of a conventional golf tee.
Figure 2:
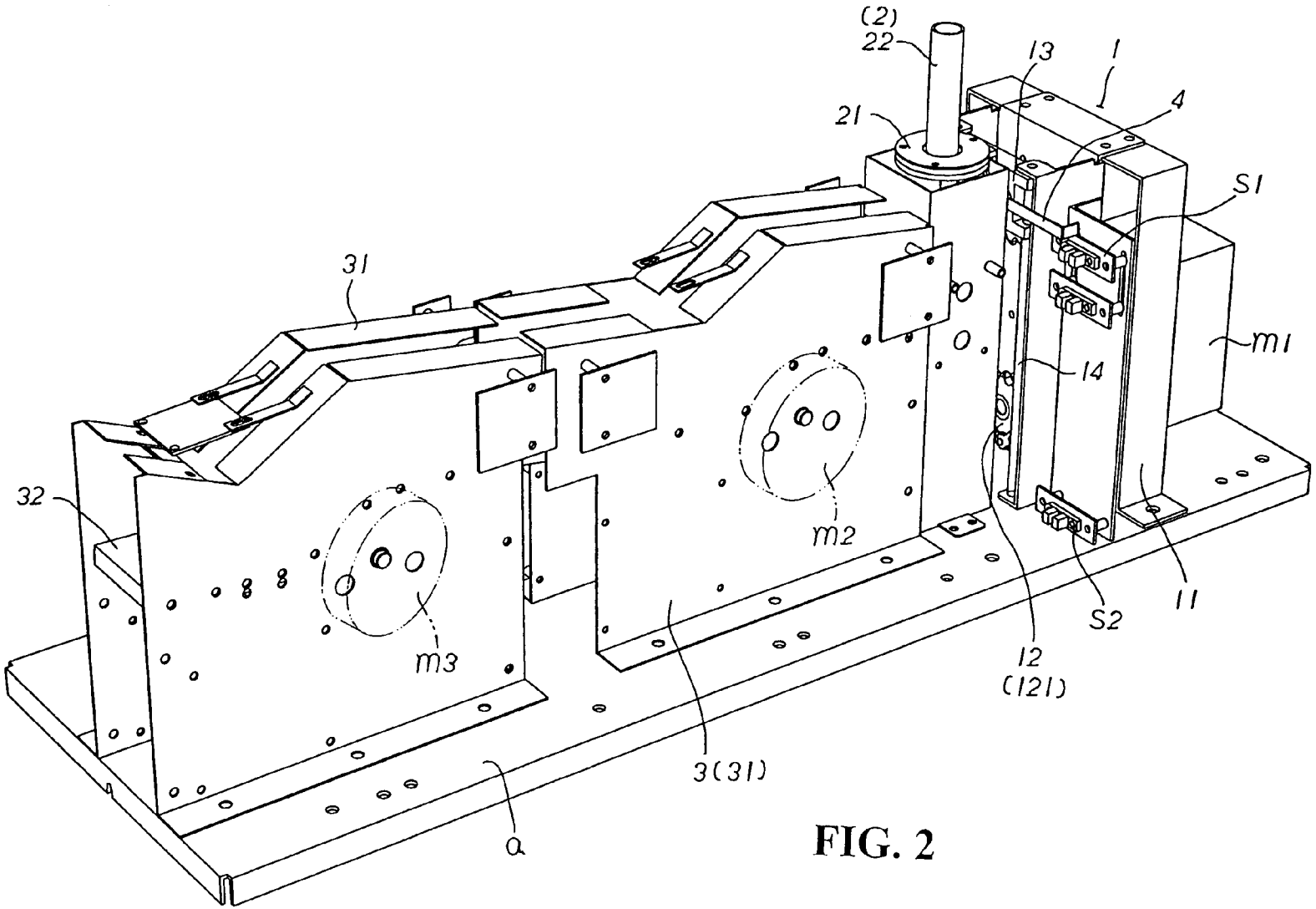
FIG. 2 is a perspective view of a golf ball dispensing device of the present invention.
Figure 3:
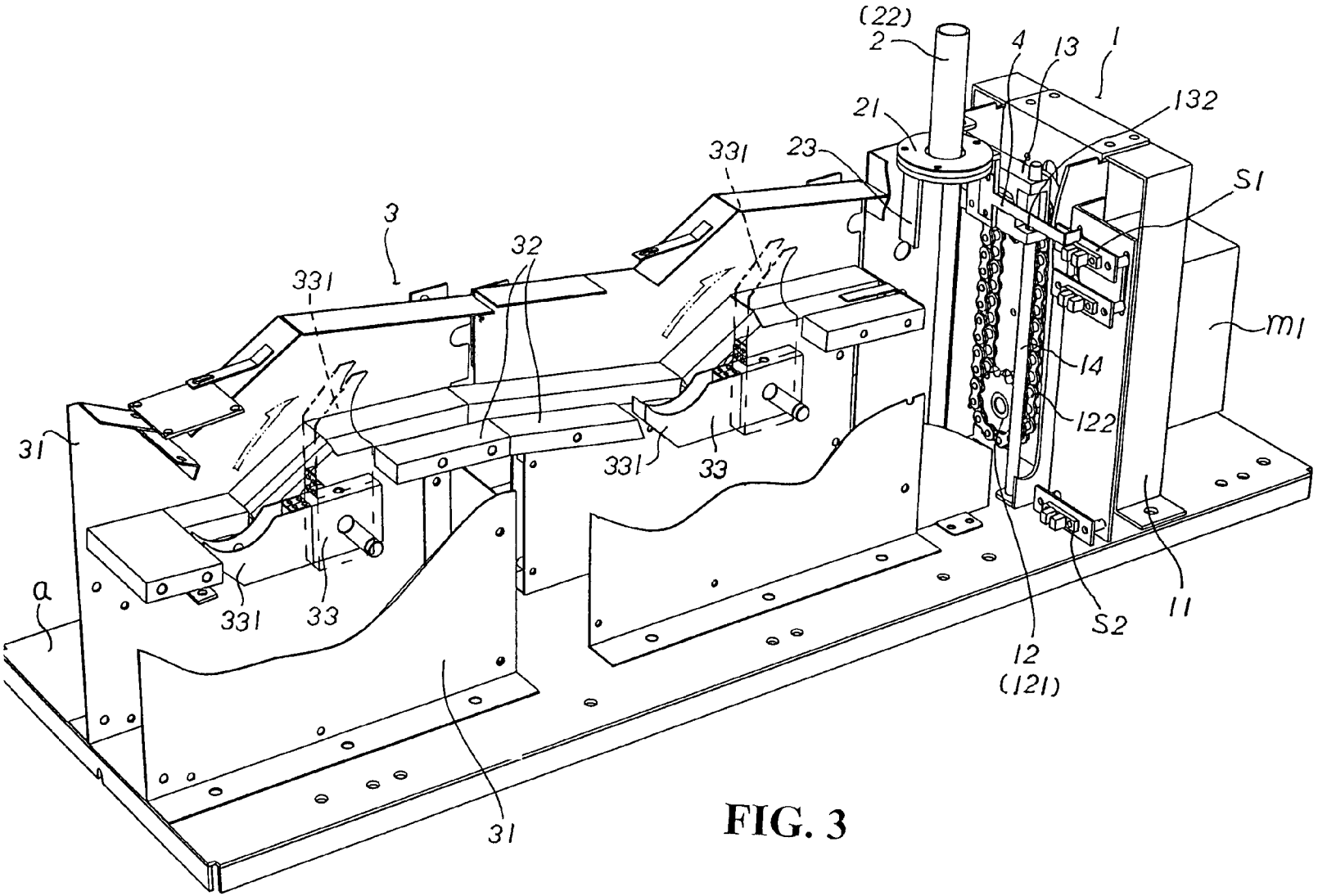
FIG. 3 is a sectional view of the dispensing device of the present invention.
Figure 4:
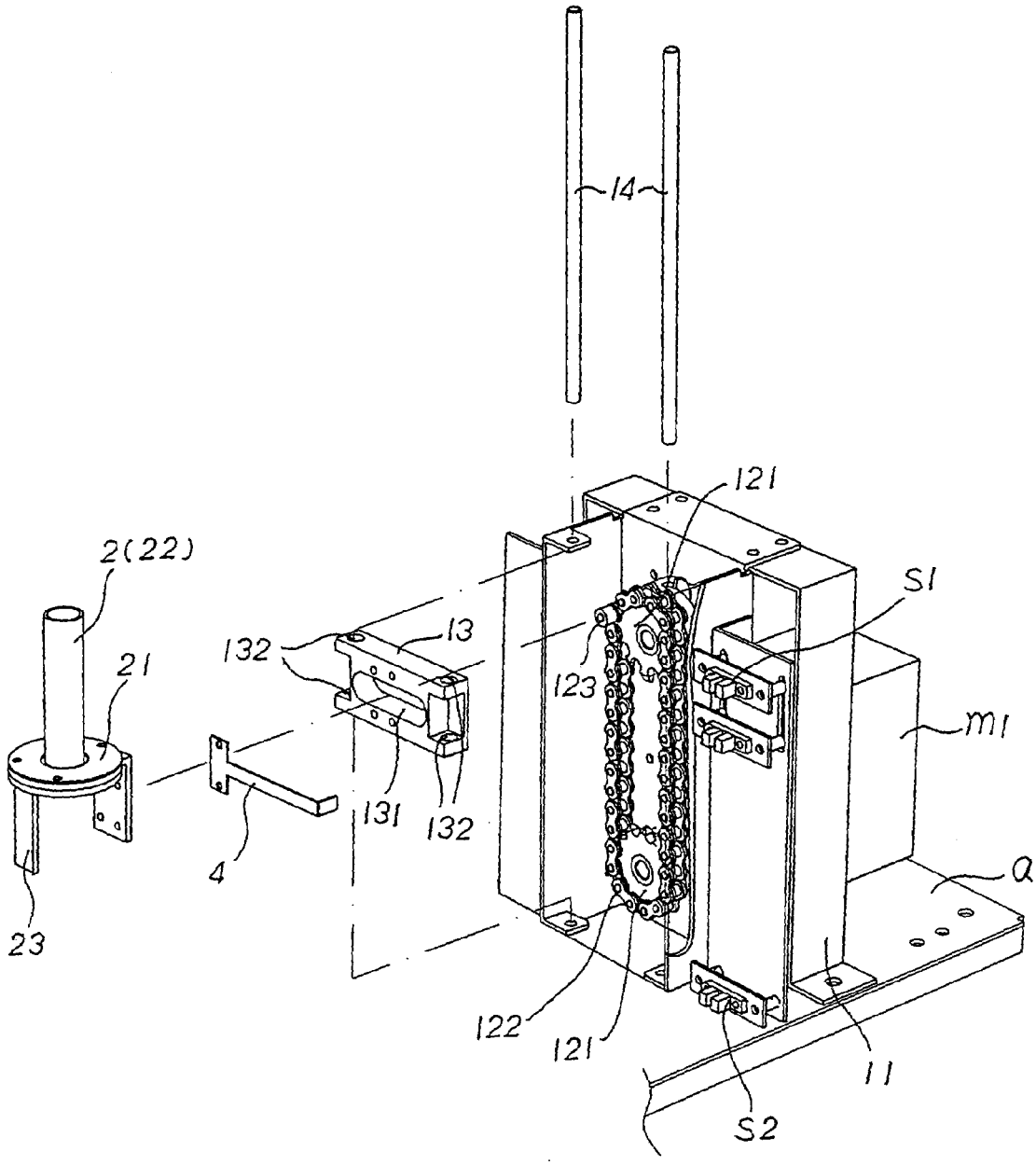
FIG. 4 is a perspective exploded view of the elevating device and the ball seat in accordance with the present invention.
Figure 5:
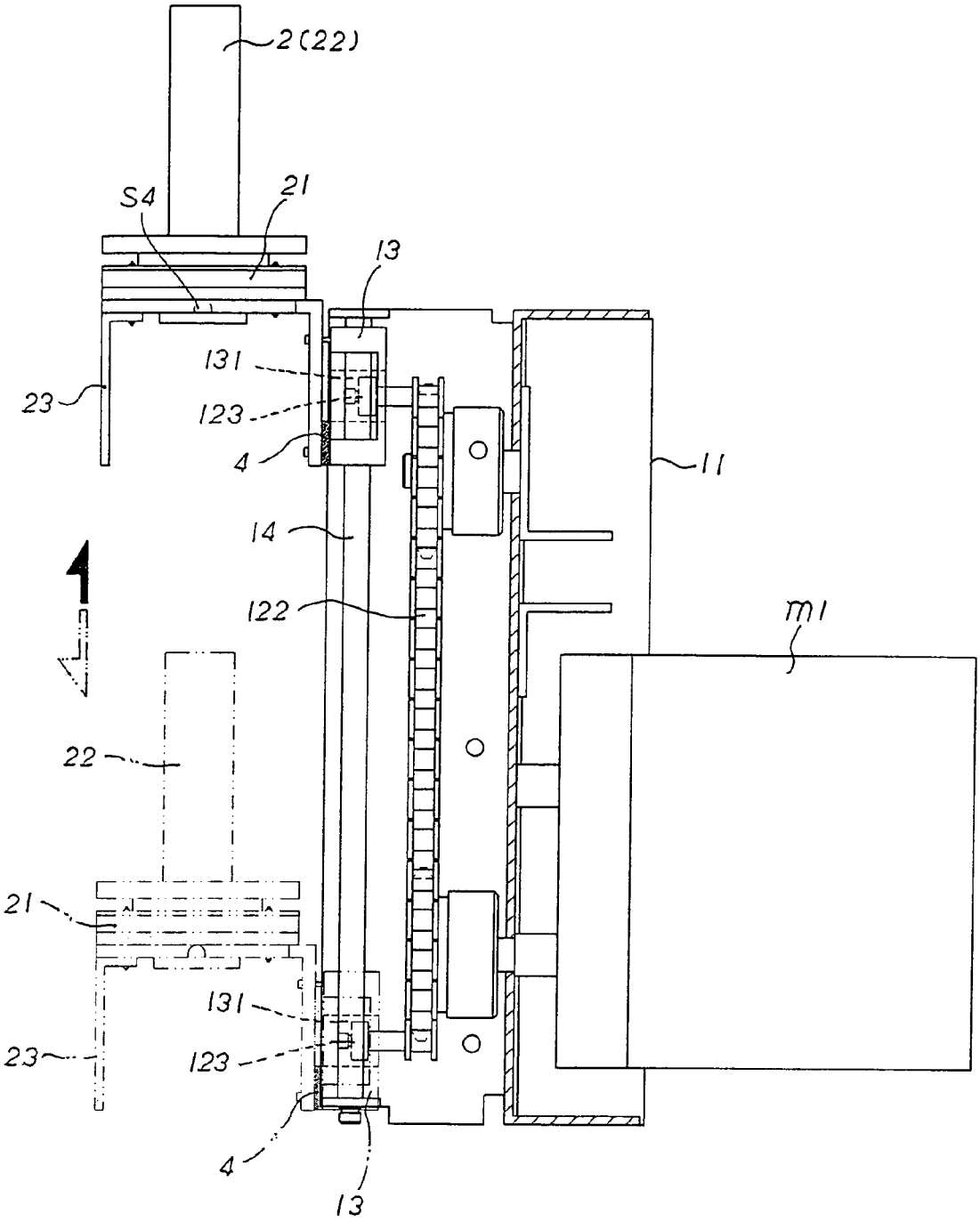
FIG. 5 is an elevational view showing the elevating device of the present invention.
Figure 6:
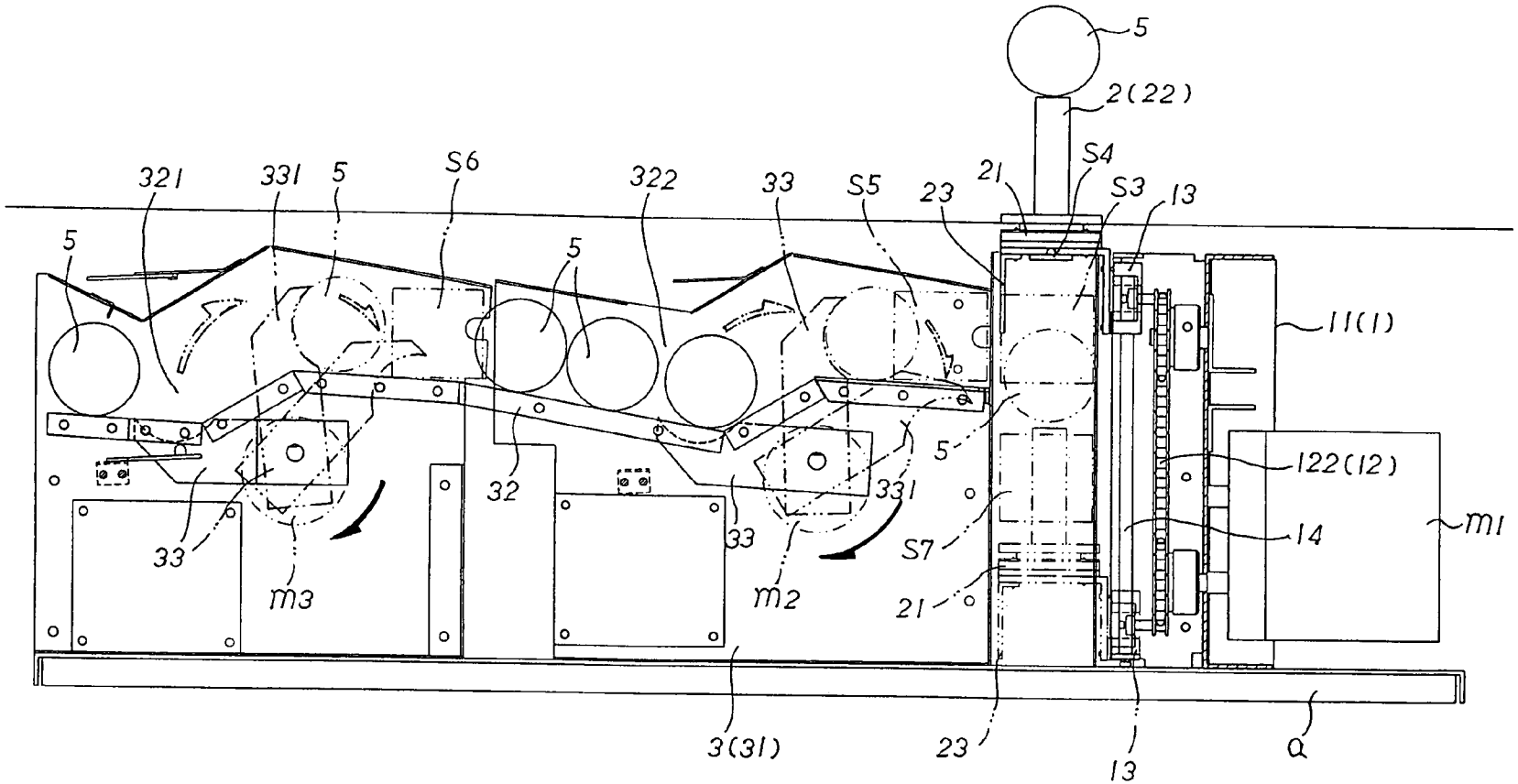
FIG. 6 is a perspective view of the dispensing device in accordance with the present invention.

Referring to FIGS. 2 and 3, there is shown a golf ball dispensing device comprising a device seat (a) mounted with an elevating device 1, a ball seat 2 and a railing device 3. The elevating device 1 includes a seat body 11, an elevating power module 12, a sliding block 13 and a first to forth sensors S1, S2, S3, S4 (as shown in FIGS. 4, 5 and 6). The seat body 11 is mounted onto the body of the device seat (a) and is connected to the elevating power module 12 and the sensors S1, S2 and S3. The sliding block 13 is pivotally mounted to the elevating power module 12. The motion of the elevating power module 12 provides elevation or lowering to the upper and lower end point (as shown in FIG. 5). The elevating power module 12 is provided with a motor (m1). The first and second sensors S1 and S2 are respectively mounted on the upper and lower portions of the seat body 11 between which the sliding block 13 can slide. The motor (m1) is connected with the elevating power module 12 so that the motor (m1) will be moved in unison with the elevating power module 12. The third sensor S3 is mounted on the sliding block 13 of the seat body 11. The fourth sensor S4 is mounted on the ball seat 2 for detecting whether there is a ball on the ball seat 2 and can move in unison with the first motor (m1). The preferred embodiment of the elevating power module 12 comprises a motor (m1), two gears 121 and a chain 122. The two gears 121 are driven by the first motor M1 so as to elevate or lower the seat body 11 to move to the upper and lower end point (as shown in FIG. 4). The chain 122 surrounds the gears 121 and there is a protrusion 123 on the chain 122. The protrusion 123 passes through a long slot 131 at the sliding block 13. The two lateral sides of the sliding block 13 are provided with a through hole 132 and two protruded bodies 14 at the seat body 11 pass through the through hole 132. When the chain 122 rotates, the long slot 131 moves to drive the sliding block 13 such that the sliding block 13 moves up and down (as shown in FIGS. 4 and 5) along the two protruded bodies 14.

The ball seat 2 (as shown in FIGS. 2 and 4) includes a base seat 21 thereunder and a ball holding rod 22 thereabove. The base seat 21 has a center hole for the passage of the ball holding rod 22 which is fastened on the bottom side of the base seat 21. The fourth sensor S4 is mounted on the bottom side of the base seat 21 and located close to the center hole of the base seat 21 (see FIG. 6). The base seat 21 is mounted onto the sliding block 13 of the elevating device 1 such that the entire ball seat 2 moves up or down together with the sliding block 131. The base seat 21 is extended externally with an extension rod 4 such that when the ball seat 2 and the sliding ball 13 move to the upper end point and lower end point, the extension rod 4 is sensed by the first and the second sensors S1, S2 so that the elevating power module 12 is restricted. The extension rod 4 of the base seat 21 of the ball seat 21 is provided with a masking rod 23 at one side. The extension rod 4 sensed by the first and the second sensor S1, S2 is also mounted on the sliding block 13.

The railing device 3 includes at least two railing plates 31, a railing body 32, a second motor M2 and a ball-pushing seat 33 (as shown in FIGS. 3 and 4). The two railing plate 31 is connected to the device seat (a), and the railing body 32 is mounted between the two railing plates 31 to form a ball-entering rail. The second motor M2 is connected with the third sensor S3 and mounted to the railing plate 31 and drives the ball seat 33 to rotate. One side of the ball seat 33 is a ball-holding section 331 and the ball-holding section 331 is a circular arch to provide rotation for the golf ball 5 on the railing body 32 by the second motor M2. The ball-holding section 331 pushes the ball body 5 to move forward to the elevating device 1 so that the ball body 5 is dropped onto the ball-holding rod 22 of the ball-holding section 332. Further, the railing body 32 is inclined (as shown in FIG. 6) at the elevating device 1, and the railing body 32 is curved so as to provide two recesses (as shown in FIG. 6) as the ready region 321 and the dispensing region 322. The railing device 3 is provided further with a third motor M3 and another ball-pushing seat 33 so that the second motor M2 and the ball-pushing seat 33 are provided at the dispensing region 322. The third motor M3 and the ball-pushing seat 33 are provided at the ready region 321 and are respectively provided with a fifth sensor S5 and a sixth sensor S6. When the second motor M2 drives the ball-pushing seat 33 to dispense a ball, the fifth sensor S5 informs the third motor M3 to move. The ball-pushing seat 33 pushes a ball into the dispensing region 322. The sixth sensor S6 informs the ball supplementary device to the ready region 321. The ready region 321 and the dispensing region 322 are designed to place specific number of balls. If there is a change in number of balls, the fifth and the sixth sensor S6 are detected, for instance, if a ball or four balls are placed on. When a ball is on the ball-holding rod 22 and the ball seat 2 is at the upper point (as shown in FIG. 6), the first sensor S1 will inform the first motor M1 to stop and ready for the ball to be impacted.

When the ball is impacted, the forth sensor S4 senses that there is no ball on the ball-holding rod 22, the motor M1 moves to drive the elevating power module 12 so that the ball seat 2 is lowered. In the lowering process, the third sensor S3 senses that there is no ball on the ball holding rod 22 and the second motor M2 causes the ball-pushing seat 33 to move forward the ball body 5 to drop at the ball seat 2. When the ball seat 2 is at the lower end point, the second sensor S2 informs the motor M1 to stop, and when the ball-holding rod 22 gets the ball body 5, the forth sensor S4 will sense and will inform the first motor M1 to move so that the elevating power module 12 is activated to drive the ball seat 2 to move upward to the upper end point. The first sensor S1 informs the first motor M1 to stop and the ball is ready. The movement is repeated. In addition, the elevation path of the ball seat 2 is provided with a seventh sensor S7 (as shown in FIG. 6) to sense the ball-holding rod 22 whether the ball is present. If the ball-holding rod 22 is absent, the seventh sensor S7 will inform the power module to stop, ready for maintenance.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A golf ball dispensing device comprising an elevating means, a ball seat and a railing means, characterized in that:

the elevating means includes a seat body, an elevating power module, a sliding block and a first, a second and a third sensors, and the seat body is mounted on the body of the dispensing device and is connected to the elevating power module and the sensors, and the sliding block is pivotally mounted to the elevating power module so that the sliding block is capable of moving upward or downward to an upper point and a lower point, and the elevating power module is provided with a first motor, the first and second sensors are respectively mounted on an upper and a lower portions of the seat body between which the sliding block can slide, the first motor is connected with the elevating power module so that the first motor will be moved in unison with the elevating power module, the third sensor is mounted on the sliding block of the seat body, the fourth sensor is mounted on the ball seat for detecting whether there is a ball on the ball seat and can move in unison with the first motor, the ball seat includes a base seat thereunder and a ball-holding rod thereabove, the base seat has a center hole for passage of the ball-holding rod, the ball holding rod is fastened on a bottom side of the base seat, the fourth sensor is mounted on the bottom side of the base seat and located close to the center hole of the base seat, and the base seat is mounted to the sliding block of the elevating means so that the base seat moves together with the sliding block, and the base seat is extended with an extension rod so that the elevation to the upper point and the lower point is stopped by the sensing of the first and second sensor;

the railing means includes two railing plates, railing body, a second motor and a ball-pushing seat, and the two railing plates are connected to the body of the dispensing device, and the railing body is mounted between two railing plates and the second motor is connected to the third sensor and mounted to the railing plates and to drive the ball-pushing seat to rotate, the ball-pushing seat has a ball-holding section at one side, allowing a golf ball to be placed on the railing body, and a second motor drives the ball-pushing seat to rotate and the ball-holding section is used to push the golf ball to move forward to the elevating means, and the golf ball to drop onto the ball-holding rod of the ball seat.

2. The golf-ball dispensing device of claim 1, wherein the elevating power module includes a motor, two gears and a chain, and the two gears are driven by the first motor and are respectively mounted to the upper and lower end of the seat body, and are surrounded by the chain having a protrusion passed through a long slot at the sliding block, the two sides of the sliding blocks are provided with through holes inserted with two protruded bodies of the seat body such that when the chain moves, the protrusion moves to push the sliding block so that the sliding block moves up or down along the two protruded bodies.

3. The golf-ball dispensing device of claim 1, wherein the corresponding side of the extension rod externally connected to the base seat of the ball seat is further mounted with a masking rod.

4. The golf-ball dispensing device of claim 1, wherein the extension rod sensed by the first and the second sensor is mounted on the sliding block.

5. The golf-ball dispensing device of claim 1, wherein the railing body at the side of the elevating means is mounted at an inclination.

6. The golf-ball dispensing device of claim 1, wherein the railing body is a curved shape to form two recess portion as a ready region and a ball delivery region, and the railing device is further mounted with a third motor and a ball-pushing seat, and the second motor and the ball-pushing seat are mounted to the ball delivery region, and the third motor and the ball delivery seat are mounted to the ready region and are respectively mounted with a fifth sensor and a sixth sensor.

7. The golf-ball dispensing device of claim 6, wherein the ready region and the ball delivery region are provided with a region to hold a specific number of balls, the number of ball change being sensed by the fifth and the sixth sensor.

8. The golf-ball dispensing device of claim 7, wherein the ready region and ball delivery region are designed for holding one ball and four balls, respectively.

9. The golf-ball dispensing device of claim 6, wherein the path for the elevation of the ball seat is provided with a seventh sensor, informing to stop providing power when the ball on the ball-holding rod is emptied.

* * * * *